US009002716B2

(12) United States Patent
Spille et al.

(10) Patent No.: US 9,002,716 B2
(45) Date of Patent: Apr. 7, 2015

(54) METHOD FOR DESCRIBING THE COMPOSITION OF AUDIO SIGNALS

(75) Inventors: Jens Spille, Hemmingen (DE); Jürgen Schmidt, Wunstorf (DE)

(73) Assignee: Thomson Licensing, Boulogne-Billancourt (FR)

( * ) Notice: Subject to any disclaimer, the term of this patent is extended or adjusted under 35 U.S.C. 154(b) by 1403 days.

(21) Appl. No.: 10/536,739

(22) PCT Filed: Nov. 28, 2003

(86) PCT No.: PCT/EP03/13394

§ 371 (c)(1),
(2), (4) Date: May 27, 2005

(87) PCT Pub. No.: WO2004/051624

PCT Pub. Date: Jun. 17, 2004

(65) Prior Publication Data

US 2006/0167695 A1 Jul. 27, 2006

(30) Foreign Application Priority Data

Dec. 2, 2002 (EP) ..... 02026770
Jul. 15, 2003 (EP) ..... 03016029

(51) Int. Cl.
*H04S 3/00* (2006.01)
*G10L 19/008* (2013.01)

(52) U.S. Cl.
CPC ..... *H04S 3/00* (2013.01); *H04S 2420/03* (2013.01)

(58) Field of Classification Search
CPC ..... H04S 3/00; H04S 3/008; H04S 2420/03; G10L 19/008
USPC ..... 704/500, 501, 502, 503; 381/17, 307
See application file for complete search history.

(56) References Cited

U.S. PATENT DOCUMENTS

| | | | | |
|---|---|---|---|---|
| 5,208,860 | A * | 5/1993 | Lowe et al. | 381/17 |
| 5,714,997 | A * | 2/1998 | Anderson | 348/39 |
| 5,943,427 | A * | 8/1999 | Massie et al. | 381/17 |
| 6,009,394 | A * | 12/1999 | Bargar et al. | 381/17 |
| 6,694,033 | B1 * | 2/2004 | Rimell et al. | 381/307 |
| 6,829,017 | B2 * | 12/2004 | Phillips | 348/738 |
| 6,829,018 | B2 * | 12/2004 | Lin et al. | 348/738 |
| 6,983,251 | B1 * | 1/2006 | Umemoto et al. | 704/270 |
| 7,113,610 | B1 * | 9/2006 | Chrysanthakopoulos | 381/309 |
| 7,116,789 | B2 * | 10/2006 | Layton et al. | 381/17 |
| 7,190,794 | B2 * | 3/2007 | Hinde | 381/17 |
| 7,266,207 | B2 * | 9/2007 | Wilcock et al. | 381/310 |
| 7,356,465 | B2 * | 4/2008 | Tsingos et al. | 704/220 |
| 7,533,346 | B2 * | 5/2009 | McGrath et al. | 715/757 |
| 7,894,610 | B2 * | 2/2011 | Schmidt et al. | 381/17 |
| 8,020,050 | B2 * | 9/2011 | DeCusatis et al. | 714/56 |
| 8,437,868 | B2 * | 5/2013 | Spille et al. | 700/94 |
| 2002/0103553 | A1 * | 8/2002 | Phillips | 700/94 |
| 2003/0053680 | A1 * | 3/2003 | Lin et al. | 382/154 |
| 2003/0095669 | A1 * | 5/2003 | Belrose et al. | 381/56 |
| 2004/0141622 | A1 * | 7/2004 | Squibbs | 381/61 |
| 2005/0114121 | A1 * | 5/2005 | Tsingos et al. | 704/220 |
| 2006/0165238 | A1 * | 7/2006 | Spille et al. | 381/23 |
| 2006/0174267 | A1 * | 8/2006 | Schmidt | 725/39 |
| 2007/0140501 | A1 * | 6/2007 | Schmidt et al. | 381/61 |
| 2014/0037117 | A1 * | 2/2014 | Tsingos et al. | 381/303 |

FOREIGN PATENT DOCUMENTS

JP 2001-169309 A 6/2001

OTHER PUBLICATIONS

Potard et al., "Using XML Schemas to Create and Encode Interactive 3-D Audio Scenes for Multimedia and Virtual Reality Applications", Distributed Communities on the Web Lecture Notes in Computer Science, vol. 2468, 2002, pp. 193 to 203.*

E.D. Scheirer et al.; "Audiobifs: Describing Audio Scenes With the MPEG-4 Multimedia Standard" IEEE Transactions on Multimedia, IEEE Service Center, Piscataway, NJ US, vol. 1, No. 3. Sep. 1999, pp. 237-250.

Search Report Dated May 14, 2004.

The MPEG-4 Book, edited by Fernando Pereira and Touradj Ebrahimi. IMSC Press Multimedia Series/Andrew Tescher, Series Editor (total pp. 16) (pp. 103-109, 112-117 and 565), (2002).

Information technology—Coding of audio-visual objects—Part 1: Systems (pp. 852) International Standard, Aug. 2001, ISO/IEC 14496-1:2001#38.

* cited by examiner

*Primary Examiner* — Martin Lerner
(74) *Attorney, Agent, or Firm* — Vincent E. Duffy; Joel M. Fogelson

(57) ABSTRACT

Method for describing the composition of audio signals, which are encoded as separate audio objects. The arrangement and the processing of the audio objects in a sound scene is described by nodes arranged hierarchically in a scene description. A node specified only for spatialization on a 2D screen using a 2D vector describes a 3D position of an audio object using said 2D vector and a 1D value describing the depth of said audio object. In a further embodiment a mapping of the coordinates is performed, which enables the movement of a graphical object in the screen plane to be mapped to a movement of an audio object in the depth perpendicular to said screen plane.

8 Claims, No Drawings

METHOD FOR DESCRIBING THE COMPOSITION OF AUDIO SIGNALS

This application claims the benefit, under 35 U.S.C. §365 of International Application PCT/EP03/13394, filed Nov. 28, 2003, which was published in accordance with PCT Article 21(2) on Jun. 17, 2004 in English and which claims the benefit of European patent application No. 02026770.4, filed Dec. 2, 2002 and European patent application No. 03016029.5, filed Jul. 15, 2003.

The invention relates to a method and to an apparatus for coding and decoding a presentation description of audio signals, especially for the spatialization of MPEG-4 encoded audio signals in a 3D domain.

BACKGROUND

The MPEG-4 Audio standard as defined in the MPEG-4 Audio standard ISO/IEC 14496-3:2001 and the MPEG-4 Systems standard 14496-1:2001 facilitates a wide variety of applications by supporting the representation of audio objects. For the combination of the audio objects additional information—the so-called scene description—determines the placement in space and time and is transmitted together with the coded audio objects.

For playback the audio objects are decoded separately and composed using the scene description in order to prepare a single soundtrack, which is then played to the listener.

For efficiency, the MPEG-4 Systems standard ISO/IEC 14496-1:2001 defines a way to encode the scene description in a binary representation, the so-called Binary Format for Scene Description (BIFS). Correspondingly, audio scenes are described using so-called AudioBIFS.

A scene description is structured hierarchically and can be represented as a graph, wherein leaf-nodes of the graph form the separate objects and the other nodes describe the processing, e.g., positioning, scaling, effect. The appearance and behavior of the separate objects can be controlled using parameters within the scene description nodes.

INVENTION

The invention is based on the recognition of the following fact. The above mentioned version of the MPEG-4 Audio standard defines a node named "Sound" which allows spatialization of audio signals in a 3D domain. A further node with the name "Sound2D" only allows spatialization on a 2D screen. The use of the "Sound" node in a 2D graphical player is not specified due to different implementations of the properties in a 2D and 3D player. However, from games, cinema and TV applications it is known, that it makes sense to provide the end user with a fully spatialized "3D-Sound" presentation, even if the video presentation is limited to a small flat screen in front. This is not possible with the defined "Sound" and "Sound2D" nodes.

In principle, the inventive coding method comprises the generation of a parametric description of a sound source including information which allows spatialization in a 2D coordinate system. The parametric description of the sound source is linked with the audio signals of said sound source. An additional 1D value is added to said parametric description which allows in a 2D visual context a spatialization of said sound source in a 3D domain.

Separate sound sources may be coded as separate audio objects and the arrangement of the sound sources in a sound scene may be described by a scene description having first nodes corresponding to the separate audio objects and second nodes describing the presentation of the audio objects. A field of a second node may define the 3D spatialization of a sound source.

Advantageously, the 2D coordinate system corresponds to the screen plane and the 1D value corresponds to a depth information perpendicular to said screen plane.

Furthermore, a transformation of said 2D coordinate system values to said 3 dimensional positions may enable the movement of a graphical object in the screen plane to be mapped to a movement of an audio object in the depth perpendicular to said screen plane.

The inventive decoding method comprises, in principle, the reception of an audio signal corresponding to a sound source linked with a parametric description of the sound source. The parametric description includes information which allows spatialization in a 2D coordinate system. An additional 1D value is separated from said parametric description. The sound source is spatialized in a 2D visual contexts in a 3D domain using said additional 1D value.

Audio objects representing separate sound sources may be separately decoded and a single soundtrack may be composed from the decoded audio objects using a scene description having first nodes corresponding to the separate audio objects and second nodes describing the processing of the audio objects. A field of a second node may define the 3D spatialization of a sound source.

Advantageously, the 2D coordinate system corresponds to the screen plane and said 1D value corresponds to a depth information perpendicular to said screen plane.

Furthermore, a transformation of said 2D coordinate system values to said 3 dimensional positions may enable the movement of a graphical object in the screen plane to be mapped to a movement of an audio object in the depth perpendicular to said screen plane.

EXEMPLARY EMBODIMENTS

The Sound2D node is defined as followed:

```
Sound2D {
    exposedField   SFFloat     intensity    1.0
    exposedField   SFVec2f     location     0,0
    exposedField   SFNode      source       NULL
    field          SFBool      spatialize   TRUE
}
```

and the Sound node, which is a 3D node, is defined as followed:

```
Sound {
    exposedField   SFVec3f     direction    0, 0, 1
    exposedField   SFFloat     intensity    1.0
    exposedField   SFVec3f     location     0, 0, 0
    exposedField   SFFloat     maxBack      10.0
    exposedField   SFFloat     maxFront     10.0
    exposedField   SFFloat     minBack      1.0
    exposedField   SFFloat     minFront     1.0
    exposedField   SFFloat     priority     0.0
    exposedField   SFNode      source       NULL
    field          SFBool      spatialize   TRUE
}
```

In the following the general term for all sound nodes (Sound2D, Sound and DirectiveSound) will be written in lower-case e.g. 'sound nodes'.

In the simplest case the Sound or Sound2D node is connected via an AudioSource node to the decoder output. The sound nodes contain the intensity and the location information.

From the audio point of view a sound node is the final node before the loudspeaker mapping. In the case of several sound nodes, the output will be summed up. From the systems point of view the sound nodes can be seen as an entry point for the audio sub graph. A sound node can be grouped with non-audio nodes into a Transform node that will set its original location.

With the phasegroup field of the AudioSource node, it is possible to mark channels that contain important phase relations, like in the case of "stereo pair", "multichannel" etc. A mixed operation of phase related channels and non-phase related channels is allowed. A spatialize field in the sound nodes specifies whether the sound shall be spatialized or not. This is only true for channels, which are not member of a phase group.

The Sound2D can spatialize the sound on the 2D screen. The standard said that the sound should be spatialized on scene of size 2 m×1.5 m in a distance of one meter. This explanation seems to be ineffective because the value of the location field is not restricted and therefore the sound can also be positioned outside the screen size.

The Sound and DirectiveSound node can set the location everywhere in the 3D space. The mapping to the existing loudspeaker placement can be done using simple amplitude panning or more sophisticated techniques.

Both Sound and Sound2D can handle multichannel inputs and basically have the same functionalities, but the Sound2D node cannot spatialize a sound other than to the front.

A possibility is to add Sound and Sound2D to all scene graph profiles, i.e. add the Sound node to the SF2DNode group.

But, one reason for not including the "3D" sound nodes into the 2D scene graph profiles is, that a typical 2D player is not capable to handle 3D vectors (SFVec3f type), as it would be required for the Sound direction and location field.

Another reason is that the Sound node is specially designed for virtual reality scenes with moving listening points and attenuation attributes for far distance sound objects. For this the Listening point node and the Sound maxBack, maxFront, miniBack and minFront fields are defined.

According to one embodiment of the invention, the old Sound2D mode is extended or a new Sound2D depth node is defined. The Sound2Ddepth mode could be similar to the Sound2D node but with an additional depth field.

| | | | |
|---|---|---|---|
| Sound2Ddepth { | | | |
| exposedField | SFFloat | intensity | 1.0 |
| exposedField | SFVec2f | location | 0,0 |
| exposedField | SFFloat | depth | 0.0 |
| exposedField | SFNode | source | NULL |
| field | SFBool | spatialize | TRUE |
| } | | | |

The intensity field adjusts the loudness of the sound. Its value ranges from 0.0 to 1.0, and this value specifies a factor that is used during the playback of the sound.

The location field specifies the location of the sound in the 2D scene.

The depth field specifies the depth of the sound in the 2D scene using the same coordinate system as the location field. The default value is 0.0 and it refers to the screen position.

The spatialize field specifies whether the sound shall be spatialized. If this flag is set, the sound shall be spatialized with the maximum sophistication possible.

The same rules for multichannel audio spatialization apply to the Sound2Ddepth node as to the Sound (3D) node.

Using the Sound2D node in a 2D scene allows presenting surround sound, as the author recorded it. It is not possible to spatialize a sound other than to the front. Spatialize means moving the location of a monophonic signal due to user interactivities or scene updates.

With the Sound2Ddepth node it is possible to spatialize a sound also in the back, at the side or above the listener, if an audio presentation system has the capability to present such features.

The invention is not restricted to the above embodiment where the additional depth field is introduced into the Sound2D node. Also, the additional depth field could be inserted into a node hierarchically arranged above the Sound2D node.

According to a further embodiment a mapping of the coordinates is performed. An additional field dimensionMapping in the Sound2DDepth node defines a transformation, e.g. as a 2 rows×3 columns Vector used to map the 2D context coordinate-system (ccs) from the ancestor's transform hierarchy to the origin of the node.

The node's coordinate system (ncs) will be calculated as follows:

$$ncs = ccs \times \text{dimensionMapping}.$$

The location of the node is a 3 dimensional position, merged from the 2D input vector location and depth {location.x location.y depth} with regard to ncs.

Example: The node's coordinate system context is $(x_i, y_i)$. DimensionMapping is (1, 0, 0, 0, 0, 1). This leads to ncs=$(x_i, 0, y_i)$, which enables the movement of an object in the y-dimension to be mapped to the audio movement in depth field The field 'dimensionMapping' may be defined as MFFloat. The same functionality could also be achieved by using the field data type 'SFRotation' that is an other MPEG-4 data type.

The invention allows the spatialization of the audio signal in a 3D domain, even if the playback device is restricted to 2D graphics.

The invention claimed is:

1. A method using an audio processing apparatus for spatialization of a sound object, the sound object having associated a first parameter, 2D location information and depth information, wherein the first parameter defines whether or not the sound object is to be spatialized, the 2D location information comprises second and third parameters that define the 2D location of the sound object in terms of height and width respectively on a 2D plane, and the depth information comprises a fourth parameter, the method comprising steps of using an audio processing apparatus to determine from the first parameter that the sound object is to be spatialized;

transforming the 2D location information and the depth information of the sound object to a 3D coordinate system, wherein said second parameter defining the height of the 2D location is mapped to audio depth information perpendicular to said 2D plane, said third parameter defining the width of the 2D location is mapped to the width information in the 3D coordinate system, and said fourth parameter is mapped to the height in the 3D coordinate system; and spatializing the sound according to the resulting 3D location information.

2. Method according to claim 1, wherein the spatialization is performed according to a scene description containing a parametric description of sound sources corresponding to the audio signals, wherein the parametric description has a hierarchical graph structure with nodes, wherein a first node comprises said 2D location information and a second node comprises at least said defining depth information, the second node being hierarchically arranged above said first node.

3. Method according to claim 2, wherein the second node comprises further data defining said step of transforming.

4. Method according to claim 2, wherein the first node further comprises an intensity parameter for adjusting the loudness of a sound, and a source parameter.

5. Method according to claim 2, wherein a soundtrack is composed from a plurality of sound objects, and wherein each of the sound objects is decoded separately.

6. Method according to claim 1, wherein said 2D plane in which the sound object is located corresponds to the screen plane of a video related to the sound object.

7. Method according to claim 6, wherein said transforming enables mapping of a vertical movement of a graphical object in the screen plane to a movement of a corresponding audio object in the depth, perpendicular to said screen plane.

8. Method according to claim 1, wherein the mapping is performed according to a 2×3 matrix or corresponding rotation.

* * * * *